US012161194B2

(12) United States Patent
Ventenat

(10) Patent No.: US 12,161,194 B2
(45) Date of Patent: Dec. 10, 2024

(54) TEXTILE FOOTWEAR ITEM AND METHOD OF MANUFACTURE

(71) Applicant: DECATHLON, Villeneuve d'Ascq (FR)

(72) Inventor: Vincent Ventenat, Villeneuve d'Ascq (FR)

( * ) Notice: Subject to any disclaimer, the term of this patent is extended or adjusted under 35 U.S.C. 154(b) by 10 days.

(21) Appl. No.: 17/802,157

(22) PCT Filed: Feb. 24, 2021

(86) PCT No.: PCT/EP2021/054615

§ 371 (c)(1),
(2) Date: Aug. 25, 2022

(87) PCT Pub. No.: WO2021/170685

PCT Pub. Date: Sep. 2, 2021

(65) Prior Publication Data

US 2023/0354950 A1 Nov. 9, 2023

(30) Foreign Application Priority Data

Feb. 25, 2020 (FR) ..... 2001849

(51) Int. Cl.

| | |
|---|---|
| ***A43B 23/02*** | (2006.01) |
| ***A43B 3/16*** | (2022.01) |
| ***A43B 23/04*** | (2006.01) |

(52) U.S. Cl.

CPC ..... *A43B 3/16* (2013.01); *A43B 23/042* (2013.01); *A43B 23/0255* (2013.01); *A43B 23/026* (2013.01)

(58) Field of Classification Search

CPC ..... A43B 23/0255; A43B 23/026

See application file for complete search history.

(56) References Cited

U.S. PATENT DOCUMENTS

| | | | | |
|---|---|---|---|---|
| 10,624,395 | B2 * | 4/2020 | Craig | D04B 1/26 |
| 2002/0066208 | A1 * | 6/2002 | Hall | A43B 3/0078 36/100 |
| 2004/0118018 | A1 * | 6/2004 | Dua | A43D 8/24 36/3 A |

(Continued)

FOREIGN PATENT DOCUMENTS

| | | | |
|---|---|---|---|
| EP | 2945505 | B1 | 11/2015 |
| EP | 3037012 | B1 | 6/2016 |

(Continued)

OTHER PUBLICATIONS

English translation of WO2019234374 (Year: 2019).*

*Primary Examiner* — Ted Kavanaugh
(74) *Attorney, Agent, or Firm* — Jonathan Bingham

(57) ABSTRACT

A footwear item including a main textile element including a main textile bootie having a sole portion secured, at least partially, to at least one sole element, the main textile element also including one or more hot-melted textile portion(s). The sole portion includes a first through-opening, and the main textile element includes at least a first additional textile part of unitary textile construction with the main textile bootie and in connection with the first through-opening. The first additional textile part may project into or out of the foot-accommodating volume of the main bootie and potentially reinforce the attachment with the sole element.

31 Claims, 8 Drawing Sheets

(56) References Cited

U.S. PATENT DOCUMENTS

| | | | | |
|---|---|---|---|---|
| 2016/0081422 | A1* | 3/2016 | Garneau | A43C 11/1493 36/7.2 |
| 2016/0206040 | A1* | 7/2016 | Cross | D04B 1/24 |
| 2019/0159550 | A1* | 5/2019 | Dean | A43B 1/04 |
| 2019/0208862 | A1* | 7/2019 | Poegl | D04B 9/22 |
| 2020/0297069 | A1* | 9/2020 | Bell | A43B 13/04 |
| 2021/0021965 | A1 | 1/2021 | Rydén et al. | |
| 2021/0219659 | A1* | 7/2021 | Ventenat | A43B 23/042 |
| 2023/0346067 | A1* | 11/2023 | Ventenat | A43B 23/0205 |
| 2023/0354950 | A1* | 11/2023 | Ventenat | A43B 9/16 |

FOREIGN PATENT DOCUMENTS

| | | | | |
|---|---|---|---|---|
| EP | 3372103 | A1 | 9/2018 | |
| EP | 3508628 | A1 | 7/2019 | |
| EP | 3508629 | A1 | 7/2019 | |
| EP | 3517671 | A1 | 7/2019 | |
| WO | 20140113674 | A1 | 7/2014 | |
| WO | 20190234374 | A1 | 12/2019 | |
| WO | WO-2019234374 | A1 * | 12/2019 | A43B 1/04 |

* cited by examiner

[Fig. 1]
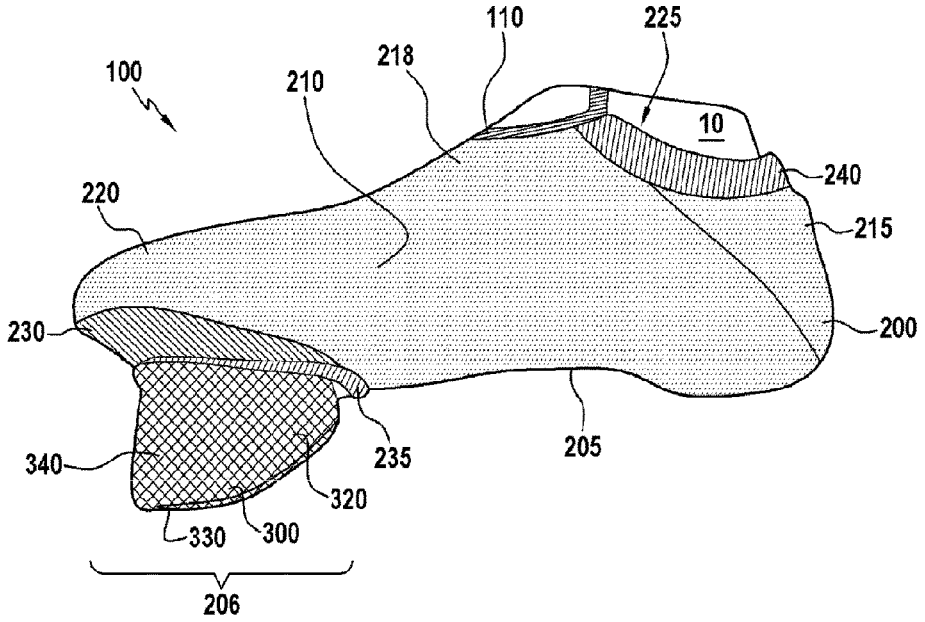
[Fig. 2]
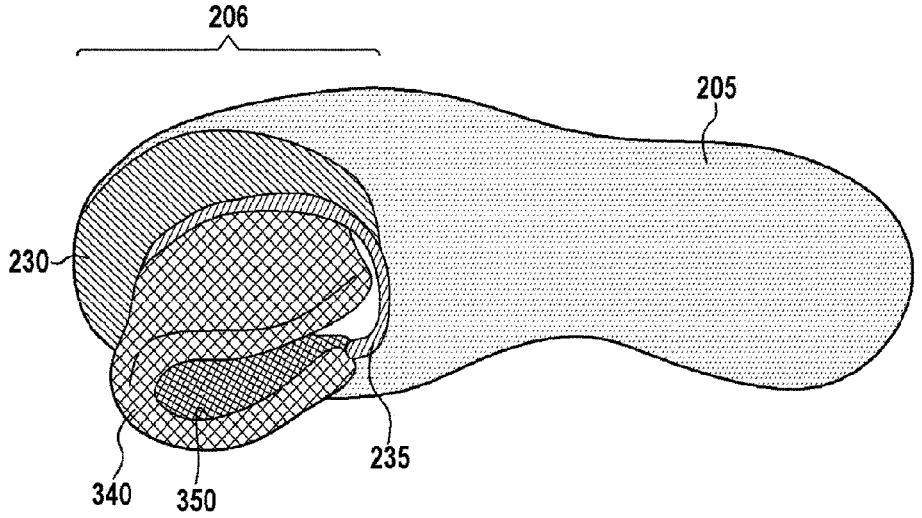

[Fig. 3]
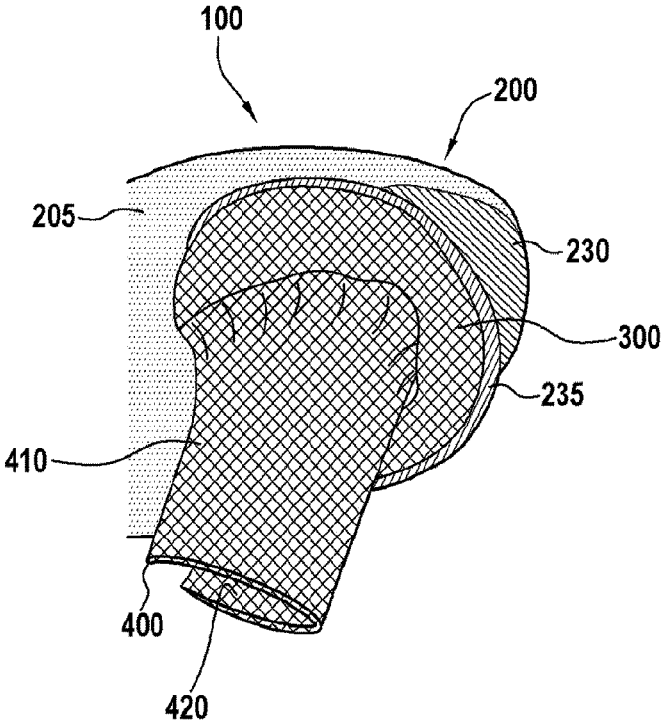
[Fig. 4]
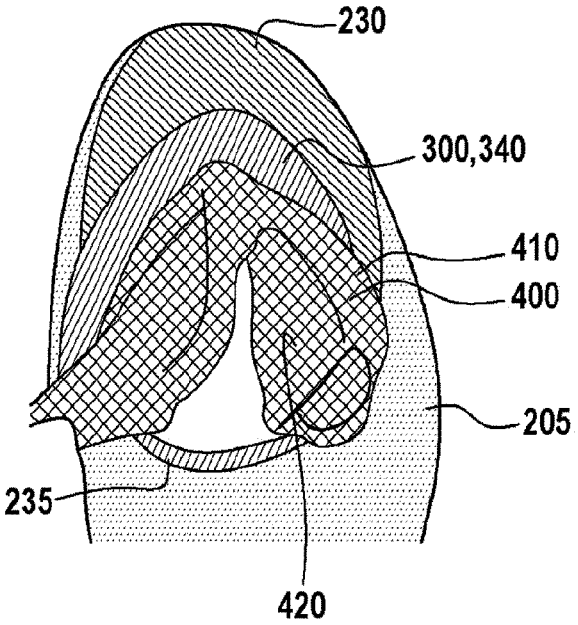

[Fig. 5]
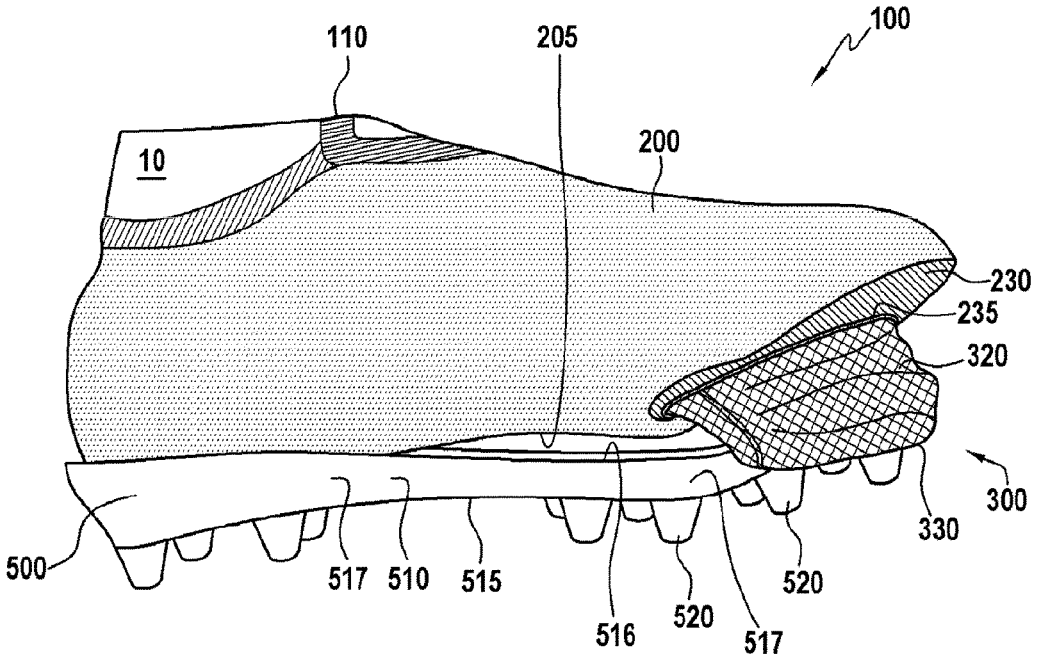
[Fig. 6]
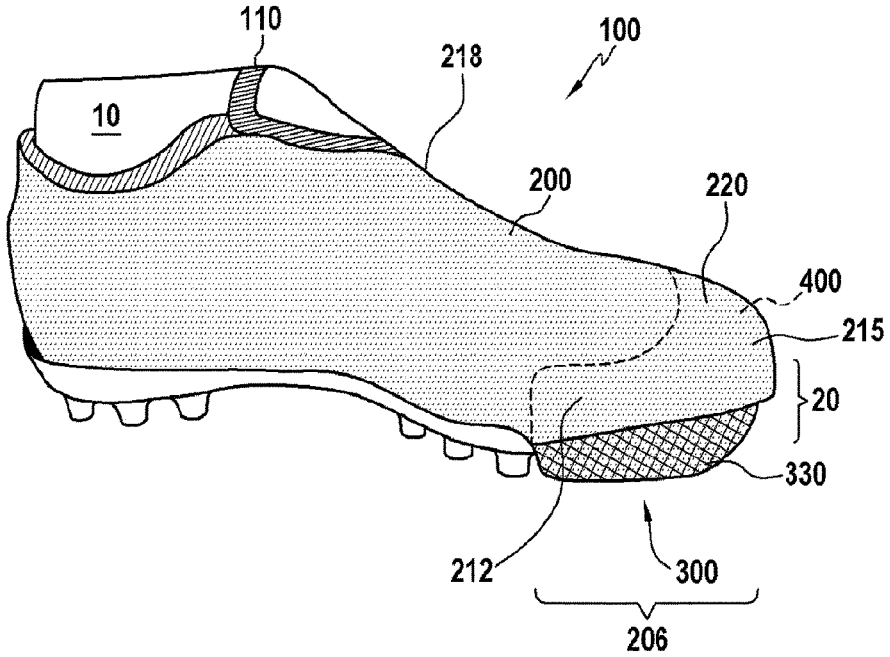

[Fig. 7]
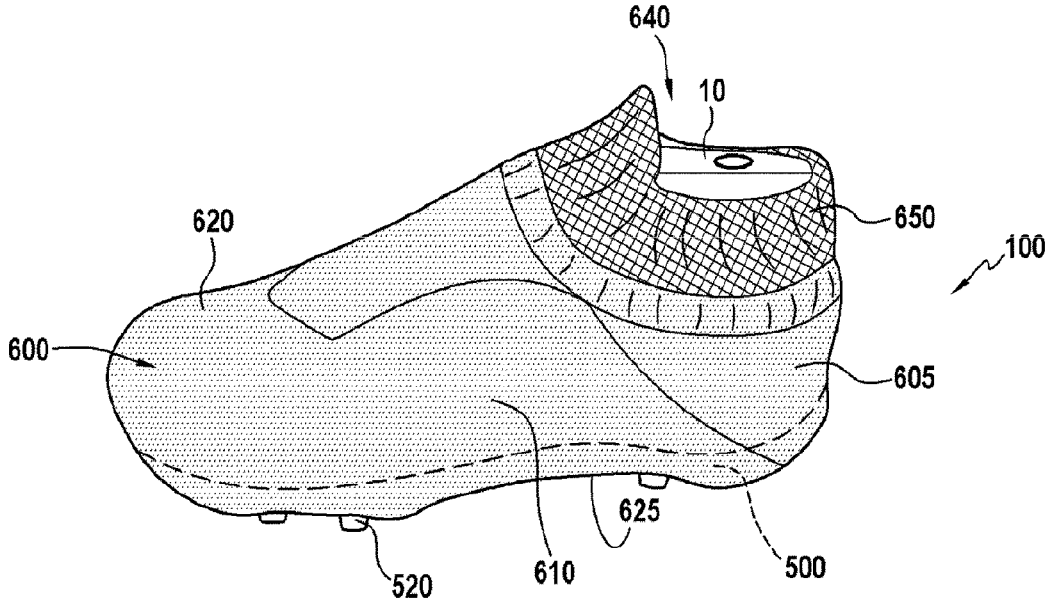
[Fig. 8]
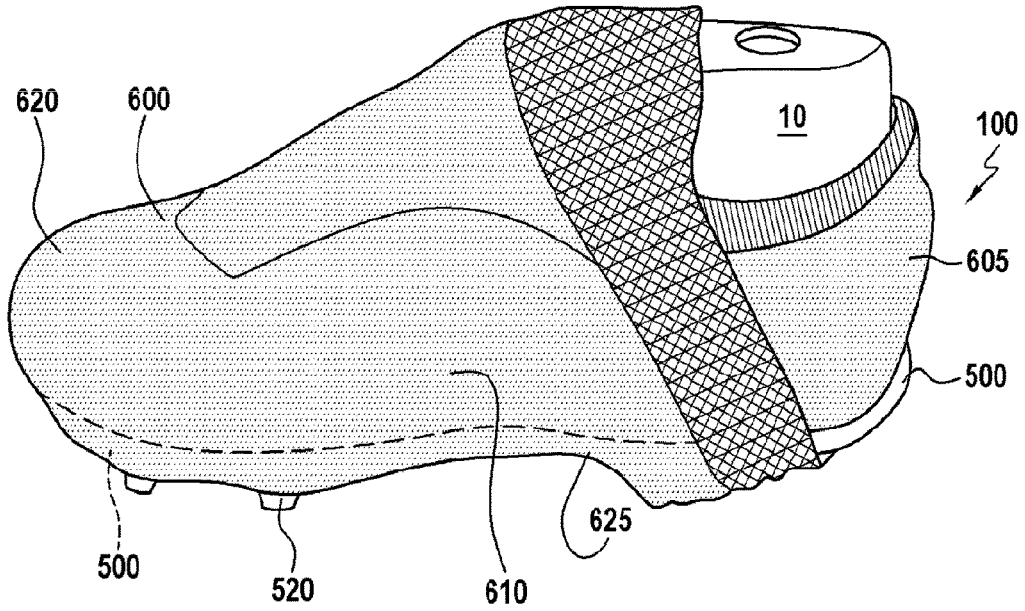

[Fig. 9]
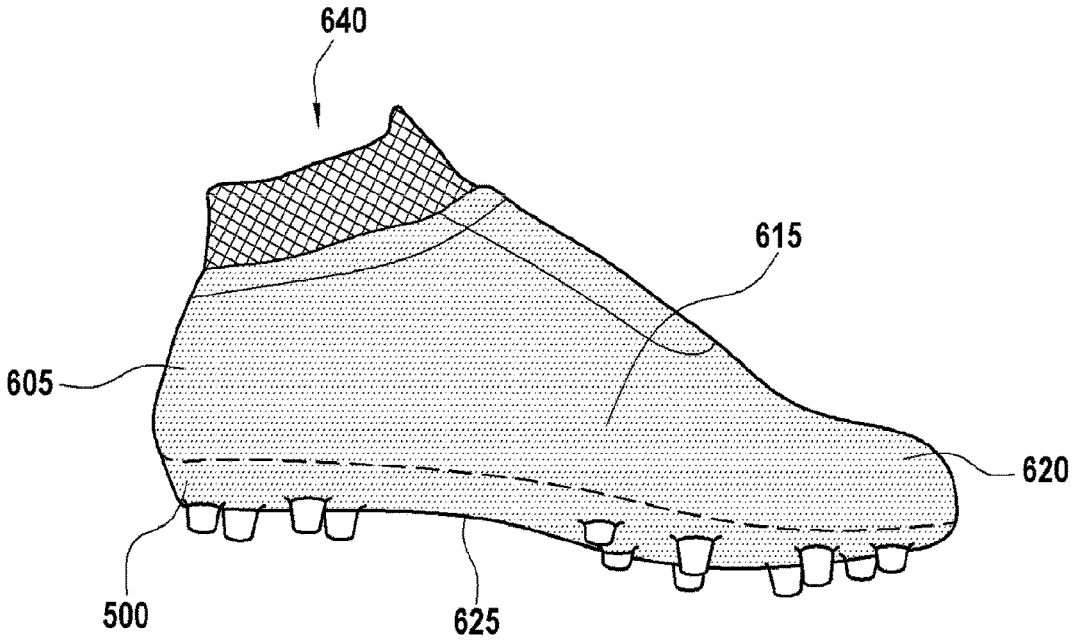
[Fig. 10]
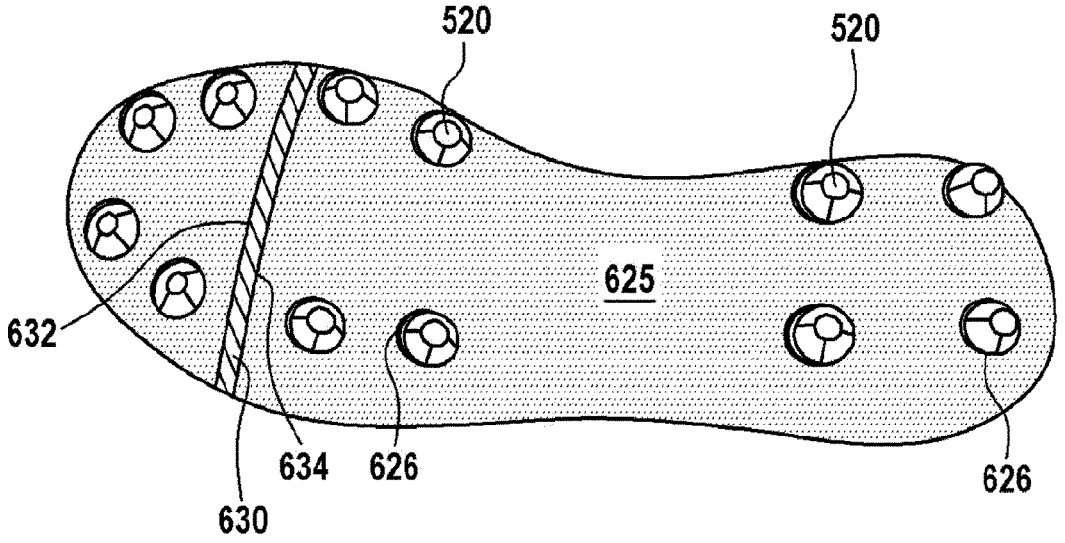

[Fig. 11]
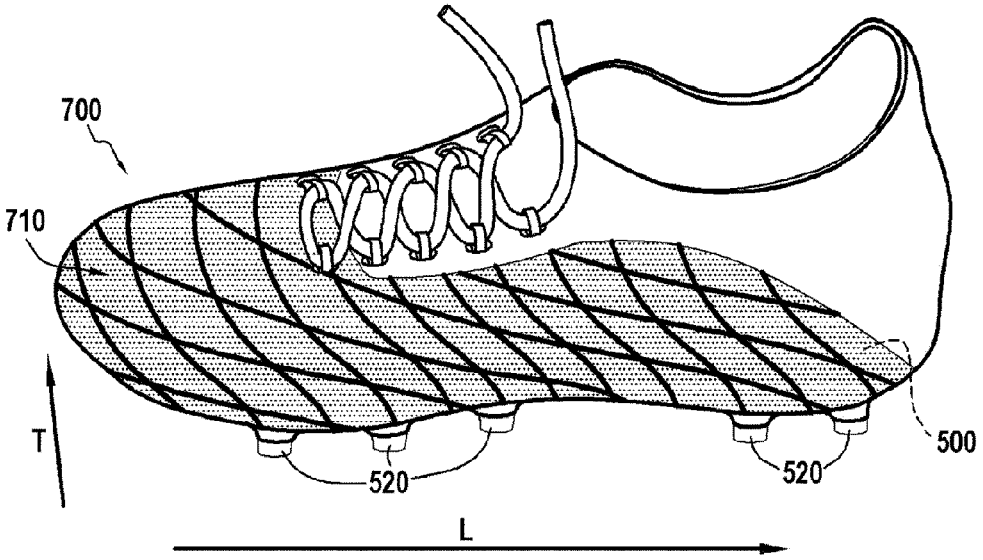
[Fig. 12]
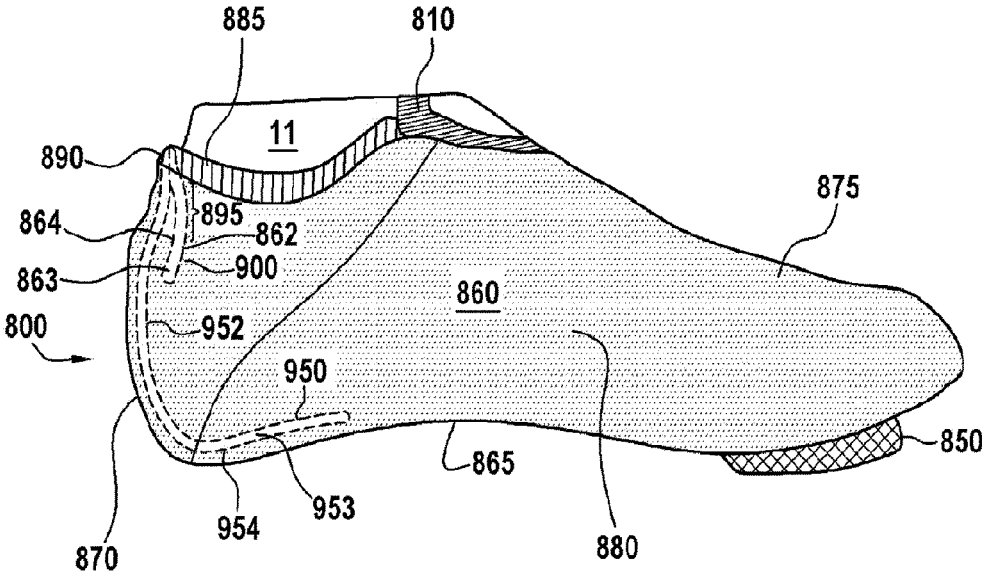

[Fig. 13]
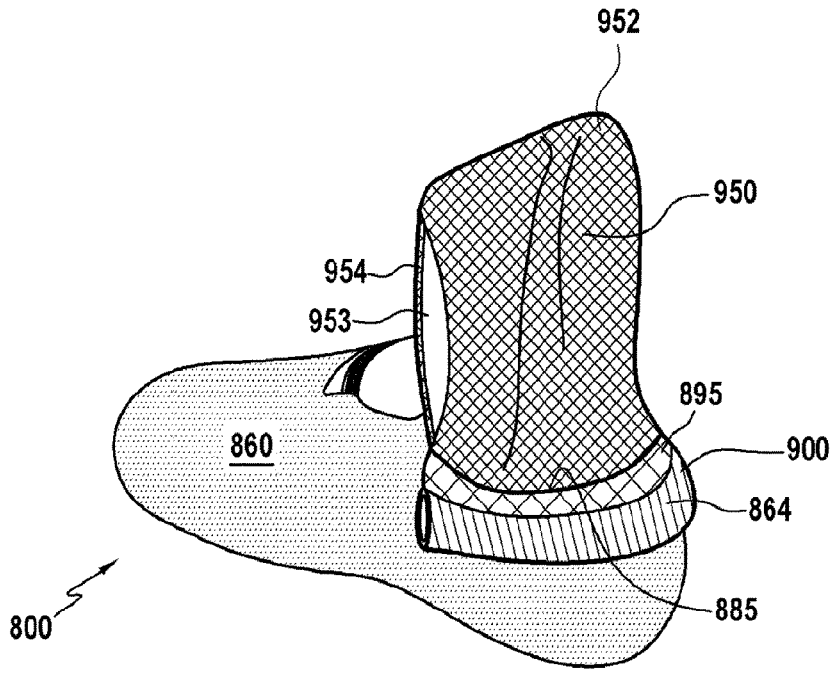
[Fig. 14]
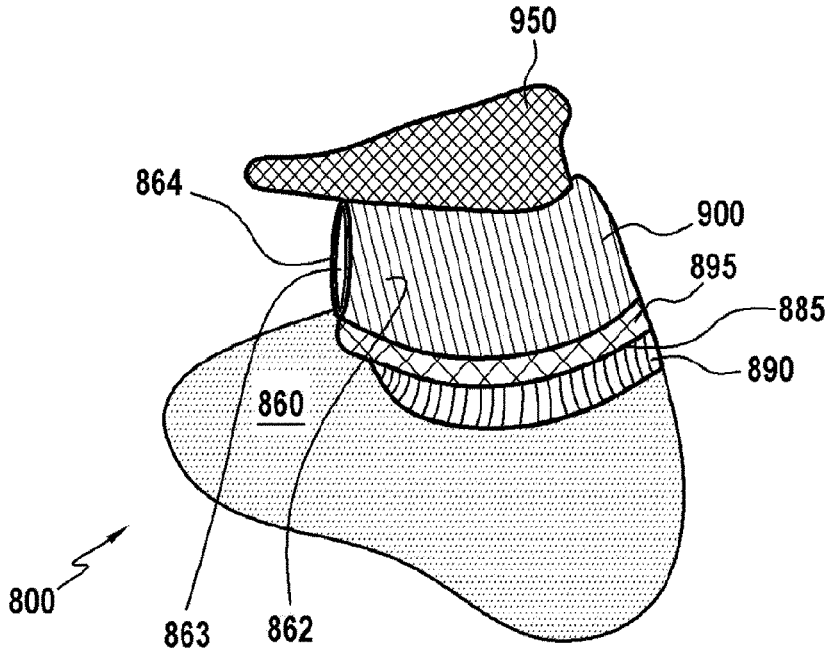

[Fig. 15]
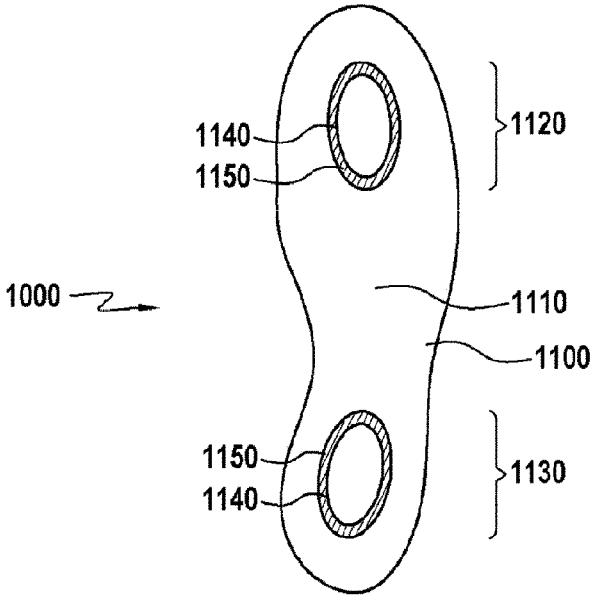
[Fig. 16]
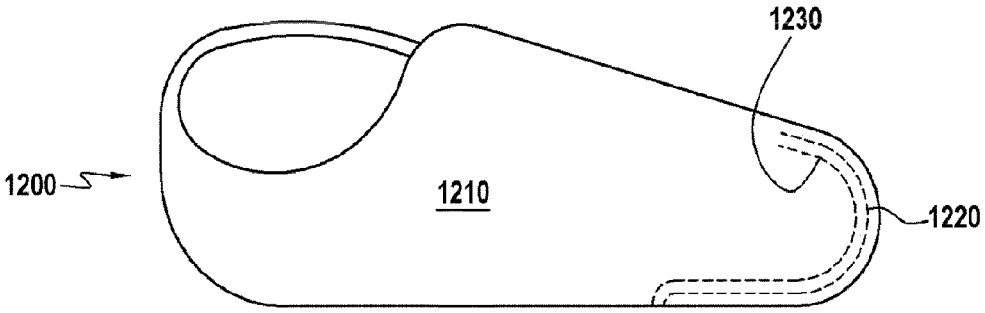
[Fig. 17]
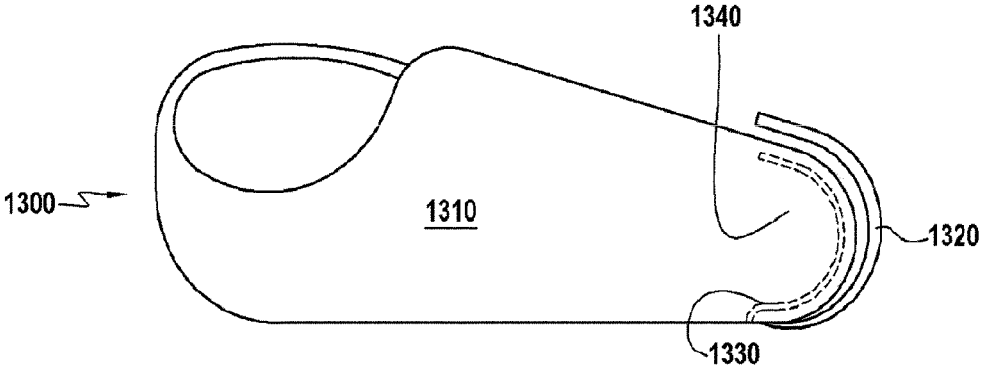

TEXTILE FOOTWEAR ITEM AND METHOD OF MANUFACTURE

TECHNICAL FIELD

The present disclosure relates to footwears including at least one textile bootie, particularly a three-dimensional textile envelope including a sole portion, including one or several hot melted textile portion(s), as well as a sole element, for example chosen among a midsole element, an outsole element or a combination thereof.

BACKGROUND

Conventional footwears generally include an upper and a sole structure. The upper is secured to the sole structure and forms a foot-receiving volume inside the footwear to comfortably receive and secure a foot. The sole structure is secured to a lower area of the upper, and operatively disposed between the ground, and the upper. In sports footwears, the sole structure may include an outsole and a midsole. The midsole often includes a polymer foam material which absorbs shocks with the ground upon impact in order to mitigate the effects on the foot and the leg during walking, running or other ambulatory activities. The sole structure may also include a lining positioned within the receiving volume and in the vicinity of the lower surface of the foot to improve the comfort of the footwear. The soles are traditionally attached to the uppers by means of a Strobel lasting during which the different sole elements (insole, midsole and outsole in particular) are bonded. The methods for manufacturing a traditional shoe require dozens of steps, and produce many scraps resulting from the cuttings of materials.

It is thus sought to simplify the methods for manufacturing footwears, in particular by reducing the number of steps and/or the consumption of energy and materials. This problem is also part of the search for a manufacturing method that may be implemented as close as possible to the place of use of the footwear in order to reduce its carbon impact, facilitate stock management, and allow customization of the footwear.

Such modifications are made in particular by eliminating the sewing steps included in shaping the initially planar upper in three dimensions. The upper is obtained from the assembly of one or a few pieces, and no longer from multiple pieces added together by sewing.

WO 2019/234374 A1 thus proposes a first textile bootie formed in three dimensions directly at the outlet of a textile loom (for example a knitting loom), partially hotmeltable, acting as an upper, then to attach this upper to an outsole. This upper is reinforced by disposing a second partially textile bootie, in three-dimensions, partially hotmeltable, around the first bootie by wrapping the junction between the first slipper and the outsole in order to improve resistance to delamination. The manufacturing method is simplified by significantly reducing the number of manufacturing steps. However, this footwear, including an upper resulting from the superposition of two, three or four textile booties, may be too heavy for the practice of some activities, in particular sports activities. For example, the standard and standardized weight of footwears for the practice of soccer is on the order of 165 g-200 g.

There is therefore also a need to lighten the footwears, particularly for them to be able to adapt to the weights imposed for the practice of a particular sport, while improving their comfort, by allowing a wide range of possible functions (reinforcement, cushioning, hard toe-puff, etc.), and this in a localized manner on the volume of the footwear, while preserving the properties of resistance to abrasion, to delamination, of flexibility, etc. usually desired.

SUMMARY

The present disclosure relates to a footwear, and a method for manufacturing such an article, solving the aforementioned problems.

The present disclosure thus relates to a lightened footwear, in particular for the practice of a sport (for example, without limitation: soccer, basketball, hiking, running, cycling . . . ), whose upper may be functionalized in a localized manner, and whose manufacturing method is simplified.

The present disclosure thus relates, according to a first aspect, to a footwear including a main textile element including a main textile bootie having a sole portion attached, at least partially, to a sole element, the main textile element also includes one or several hot melted textile portion(s). The sole portion includes a first through-opening, and the main textile element includes at least one first additional textile part (A), of unitary textile construction with the main textile bootie, and in connection with the first through-opening.

Advantageously, the first additional textile part (A) is not a textile bootie, and allows functionalizing the footwear, for example by functionalizing a portion of the internal face or the external face of the main textile bootie or even the junction between the main textile bootie and the sole element. The main textile bootie is preferably in the form of a substantially hollow elongated structure, such as a tube. The first through-opening disposed on the sole portion of the main textile bootie is advantageously used to manufacture on the textile loom, in particular the knitting loom, one or several additional textile part(s), such as the first additional textile part (A), of unitary textile construction with the main textile bootie. This disposition allows saving the disposition of an auxiliary textile bootie and therefore adjusting the mass of the footwear. In addition, the additional textile part being of unitary textile construction with the main textile bootie, the method for manufacturing the upper is simplified. The placement of the additional textile part for the thermo-forming or thermo-compression step described below is also facilitated.

In one embodiment, the main textile bootie, and optionally the auxiliary textile bootie described below, has/have (each) a generally hollow and elongated shape, in particular substantially in the form of a tube, and includes first and second through-openings opening out into its interior volume (and including the foot-receiving volume). The second through-opening preferably forms the opening for introducing the foot into the foot-receiving volume of the footwear. The first through-opening is disposed on the sole portion of the main textile bootie, particularly either in the forefoot part, or in the rearfoot part thereof or in the intermediate region of the foot (in particular including the arch of the foot).

Preferably, in practice, the first additional textile part (A) is first knitted, then one or several other additional textile part(s) may then be knitted, and finally the main textile bootie is knitted, while being in connection with at least the first additional textile part at the level of the first through-opening. The first additional textile part (A) is thus preferably knitted at the same time as the main textile bootie, in a single knitting step.

Preferably, the main textile bootie and/or the auxiliary textile bootie and/or the main textile element and/or the first and/or second and/or third and/or fourth additional textile part(s) is/are knitted.

First Additional Textile Part (A)

Preferably, the first additional textile part (A) is manufactured at the same time as the main textile bootie on the textile loom, for example a knitting, weaving or braiding loom, preferably a knitting loom.

Preferably, the first additional textile part (A) is in textile connection, in particular knitted connection, with the first through-opening.

The first additional textile part (A) is preferably bonded by knitting, in particular along its upper edge, to the edge of the first through-opening.

The first additional textile part (A), and optionally the second and/or third and/or fourth additional textile part(s) (B, C or D), preferably include(s) first and second textile layers, particularly substantially superimposed. Again preferably, the first and second textile layers are attached together along at least one of their edges chosen among the upper, lower, lateral and medial edges, in particular along their upper and lower edges. Preferably, the upper edges of the first and second textile layers are bonded, in particular by knitting, to the edge of the first or second through-opening.

Preferably, the first textile layer and/or the second textile layer of the first additional textile part (A) include(s) (each) one or several hot melted textile portion(s)

The first additional textile part (A) may ensure one or several function(s) as described in the present text, and for example forms a front hard toe-puff, a rear reinforcement, or a cushioning area. The cushioning area may be configured to come under the foot of the user.

The first additional textile part may at least partially cover the sole portion of the main textile bootie, for example in the front part and/or the rear part of the sole portion, and/or may at least partially cover the front portion and/or the rear portion and/or the medial portion and/or the lateral portion of the main textile bootie.

Preferably, the ratio of the mass of the hot melted textile portion(s) of the first textile layer and/or the second textile layer of the first additional textile part (A) to the total mass of the first textile layer and/or the second textile layer is greater than or equal to 50%, more preferably greater than or equal to 80%, particularly greater than or equal to 90%.

Preferably, the footwear article in the present text includes a longitudinal axis L extending substantially between the back and the front of the article. The footwear also includes a transverse axis T, in particular substantially perpendicular, to the longitudinal axis L and extending between the medial edge and the lateral edge of the footwear.

Main Textile Element

The main textile element is preferably of unitary textile construction, more preferably of unitary knitted construction.

We understand by main textile element, or main or auxiliary textile bootie, or additional part (A, B, C, or D) of "unitary textile, in particular knitted, construction" that the element, bootie or part is in one piece. It may include seams or other attachment areas but they are used for its shaping and/or for the finishing of its edges.

The main textile element may include one or several other additional textile part(s), in particular a second and/or a third and/or a fourth additional textile part(s). Preferably, the additional textile part(s) include(s) first and second, in particular substantially superimposed, textile layer(s).

In one embodiment, the first and/or the second and/or the third and/or the fourth additional textile part(s) partially cover(s) the internal face and/or the external face of the main textile bootie.

The first textile layer and/or the second textile layer of the second and/or the third and/or the fourth additional textile part(s) include(s) one or several textile hot melted portion(s).

Main Textile Bootie, Auxiliary Textile Bootie (Described Below)

Preferably, the main textile bootie, and/or the auxiliary textile bootie, is/are (each) a textile, in particular knitted, envelope including a sole portion (covering all or partly the underside of the foot of the wearer of the footwear); a lateral portion (covering all or partly the lateral side of the foot of the wearer of the footwear); a medial portion (covering all or partly the medial side of the foot of the wearer of the footwear); a front portion, in particular in the extension of the lateral, medial and sole portions (covering all or partly the front of the wearer's foot); and a rear portion, in particular in the extension of the medial, lateral and sole parts (intended to cover all or partly the back of the wearer's foot).

The main textile bootie and/or the auxiliary textile bootie each include(s) an interior volume, in particular corresponding, at least wholly or partly, to the volume for receiving the foot in the footwear.

The first additional textile part preferably projects outside the main textile bootie, that is to say outside its interior volume.

The first additional textile part (A) may also project into the interior volume of the main textile bootie.

In one embodiment, the at least one first additional textile part (A) includes one or several hot melted textile portion(s), in particular thermo-bonded to the internal face or to the external face of the main textile bootie.

Preferably, the main textile bootie is of unitary textile, particularly knitted or woven, in particular knitted, construction.

Hot Melted Textile Portion(s)

The hot melted textile portion(s) correspond(s) to one or several textile portion(s) including one or several hot melted yarn(s) entirely or partly (and therefore hot-melt entirely or partly before their melting).

Thermal-Fused Yarn(s) and/or Non-Thermal-Fused Yarn(s)

It is meant by textile in the present text that the main textile element and/or the main textile bootie and/or the auxiliary textile bootie and/or the first and/or second and/or third and/or fourth additional textile part(s) (A, B, C, D) include(s) (each) (or is/are made up of) one or several yarn(s), particularly one or several yarn(s) hot melted entirely or partly (and therefore hot meltable entirely or partly before their melting) and/or one or several non-hot melted, in particular knitted, braided, or woven, preferably knitted, yarn(s).

The (fully or partly hot melted, and/or non-hot melted) yarn(s) may be chosen among one or several monofilament yarn(s), one or several fiber spun yarn(s), multifilament yarn(s), elongated element(s) (e.g. a braid, a cable, a tape, etc.), or a combination thereof. The yarns may be of the same color or be in different colors.

The monofilament yarn(s) preferably has/have a diameter greater than or equal to 0.01 mm and less than or equal to 5 mm, more preferably greater than or equal to 0.1 mm and less than or equal to 2 mm.

The multifilament yarn(s) and/or fiber spun yarn(s) has/have preferably a fineness greater than or equal to 10 dtex and less than or equal to 1,000 dtex, still preferably greater than or equal to 30 dtex and less than or equal to 500 dtex.

In one embodiment, the textile element, particularly the main textile bootie and/or the part (A, B, C or D), include(s) one or several multifilament yarn(s) whose fineness is included between 300 dtex and 600 dtex (lower and upper bounds included), in particular made of polyethylene terephthalate, particularly of 468 dtex for 204 filaments.

The multifilament yarn(s) may be one or several textured yarn(s) FDY (Full Drawn Yarn), DTY (Draw Textured Yarn) or POY (Partially Oriented Yarn), or a mixture thereof.

The hot melted yarn(s), fully or partly, is/are one or several yarn(s) including one or several hot melted component(s), for example a first component having a melting temperature less than or equal to the hot processing temperature of the footwear, and optionally a second component having a melting or degradation temperature greater than the hot processing temperature of the footwear. The melting or degradation temperature of the second component or of a non-hot melted material according to the disclosure is higher than the melting temperature of the first component.

The bi-component yarns may be of the core-sheat type, the core including the second component, and the sheat including the first component.

The entirely or partially hot melted yarn(s) can be one or several single-component yarn(s) whose melting temperature is less than or equal to the hot processing temperature of the footwear.

The single-component hot melted yarn(s) has/have (each) preferably a fineness included between 300 dtex and 900 dtex (bounds included), particularly included between 400 dtex and 800 dtex (bounds included), in particular on the order of 600 dtex.

The first component may be chosen among polyurethanes, in particular thermoplastic polyurethanes, polyamides, such as polyamide 6 or 66, polyolefins, such as polypropylene (PP) or polyethylene (PE), preferably among polyurethanes.

The first component may be colored, colorless and/or opaque or transparent.

The second component may be chosen among polyolefins, such as high-density polyethylene, polyamides, such as polyamide 4-6, polyesters, such as polyethylene terephthalate.

The non-hot melted yarn(s), that is to say whose melting or degradation temperature is higher than the maximum hot processing temperature of the footwear, is/are chosen among a first list (I) of synthetic compounds: polyesters, in particular polyethylene terephthalate; polyamides, such as PA 6, PA 66, PA 4-6, PA 12; polyolefins, such as polypropylene, polyethylene, PEEK, UHMWPE (ultra high molecular weight polyethylene); aramids, in particular meta-aramid or para-aramid or a mixture thereof; vinyl acetates; polyacrylics, such as polyacrylonitrile; elastomers; elastanes, or a mixture thereof; and/or a second list of compounds, particularly natural compounds or compounds derived from regenerated natural materials: cotton, viscose, linen, sisal, wool, jute, silk, hemp, and/or a third list of inorganic compounds: carbon, mineral fibers, such as rock fiber, glass.

The yarn(s), in particular non-hot melted yarn(s), may also be one or several elastic yarn(s).

We understand by elastic yarn any yarn whose elongation at break is greater than or equal to 200%, particularly greater than or equal to 300%, particularly greater than or equal to 400%. The elastic yarn preferably includes an elastic core, in particular made of elastane, and optionally one or several covering yarns, in particular from the list I or II cited above. The elongation may be measured using the standard ASTM D 1578-93 (2016). By definition, the elastic yarn is not hot melted. The elastic yarn is therefore made of one or several material(s) whose melting and/or degradation temperature is higher than the maximum hot processing temperature of the footwear.

The knitting loom used to knit the main textile element, and therefore the main textile bootie and the first additional textile part (A), and possibly the parts B, C or D, or the auxiliary textile bootie, described below, may be a circular knitting loom, preferably of small diameter, or a rectilinear knitting loom, preferably with a reduced width of the needle beds. It may be a Jacquard knitting loom using the intarsia technique, making it possible in particular to knit a textile part A, B, C or D with the main textile bootie, and possibly the auxiliary textile bootie.

The main textile element, particularly the main textile bootie and/or the first additional textile part (A) (or the part(s) B, C and/or D), may be in a weft or warp knitted piece, in particular with non-run stitches, but is preferably in a weft knitted piece (the stitches are formed in the weft direction).

Sole Element

The sole element may be a midsole element or an outsole element or a combination thereof.

The outsole element and/or the midsole element and/or the sole element each has/have an internal face, particularly oriented towards the sole portion of the main textile bootie, and an external face oriented towards the outside of the footwear, in particular coming into contact with the ground in operation with regard to the outsole. The sole element may be glued, heat-bonded and/or sewn to the sole portion of the main textile bootie, or extruded or injected and (over)molded, or obtained by additive manufacturing, directly on the sole portion of the main textile bootie.

The sole element is preferably a molded piece or three-dimensional textile piece, which is bonded entirely or partly to the sole portion of the main textile bootie during a thermo-compression step allowing the formation of the hot-melted textile portions. Preferably, one or several hot melted textile portion(s) adhere(s) to the internal face of the sole element. Again preferably, the hot melted portion(s) and the internal face of the sole element include the same material, for example polyurethane. This disposition promotes adhesion during the thermo-compression between the hot melted portions, in particular of the sole portion, and the internal face of the sole element.

The outsole may include one or several projection(s) projecting from its external face, in particular intended to come into contact with the ground, said projection(s) may be one or several stud(s), or a heel pad or a shock-absorbing member.

The sole element may be made of one or several material (s) chosen among: polyurethanes, in particular thermoplastics, thermoplastic elastomers, silicones, natural or synthetic rubbers, such as ethylene-vinyl acetate (EVA), for example styrene butadiene rubber, EPDM (ethylene-propylene-diene monomer) rubbers, polyamides, or mixtures thereof.

Preferably, the projection(s) projecting from the external face of the outsole is/are also made of the material(s) chosen among those mentioned above.

We understand by junction in the present text, the region in which the sole element and the main textile bootie are joined.

The main textile element and/or the auxiliary textile bootie may include one or several zoning region(s), that is to say locally functionalized according to one particular arrangement of yarns, and according to the nature and the fineness of the yarns.

Preferably, the footwear according to the disclosure is a footwear for the practice of sport, for example (and without limitation): soccer, basketball, hiking, running, cycling, . . . .

In a first variant, the main textile slipper includes an external face, and the first additional textile part partially wraps the external face of the main textile bootie.

Preferably, the first additional textile part (A) projects outside the main textile bootie, and partially wraps the external face of the main textile bootie by being turned against it.

Preferably, the first additional textile part (A) wraps partially the tip of the foot of the main textile bootie, and partially the lateral and medial, and possibly front, portions of the main textile bootie.

It is possible to cover the main textile bootie to a greater or lesser extent depending on the dimensions chosen for the first additional textile part (A), particularly by varying the height of the part (A), that is to say the distance separating substantially its upper and lower edges.

In a second variant, the main textile slipper includes an internal face, and the first additional textile part partially wraps the internal face of the main textile bootie.

Preferably, the first additional textile part (A) projects into the interior volume of the main textile bootie, and partially wraps the internal face of the main textile bootie by being turned against it.

Preferably, the first additional textile part (A) partially wraps the sole portion, and optionally the tip of the foot and/or the front portion, of the main textile bootie, and partially the lateral and medial portions, of the main textile bootie.

In a third variant, the first additional textile part (A) at least partially wraps the sole element, particularly the first additional textile part (A) includes an intermediate textile portion disposed between the sole portion of the main textile bootie and the sole element.

Advantageously, the resistance to delamination between the sole portion of the main textile bootie and the sole element is improved locally without the need to use an additional textile bootie covering the entire junction area between the main textile bootie and the sole element. The final upper including the main textile element is thus lightened.

Preferably, the first additional textile part, also referenced (A) in the remainder of the present text, projects from the main textile bootie outside the main textile bootie.

Preferably, the first additional textile part includes an intermediate textile portion disposed between the sole portion of the main textile bootie and the sole element, and a wrapping textile portion, in particular in the extension of the intermediate textile portion, partially wrapping the sole element.

If the footwear did not include a first additional textile part (A), the junction between the sole element and the main textile bootie would include a rigid area formed by the sole element in contact with a flexible area formed by the main textile bootie alone, so that the flexible area of the main textile bootie would be abraded and would form an area of weakness promoting the onset of delamination with the sole element.

In the footwear according to the disclosure, the junction includes one or several flexible additional textile layer(s) (including at least the first additional textile part (A)) which extend(s) between the sole portion of the main textile bootie and the sole element, and partially wraps(s) the sole element). This disposition allows locally reinforcing the main textile bootie, as well as the junction between the main textile bootie and the sole element.

Preferably, when the first additional textile part (A) includes first and second layers, the second textile layer is partially disposed between the first textile layer and the sole element.

Preferably, the mass of the hot melted textile portion(s) of the first textile layer is smaller than the mass of the hot melted textile portion(s) of the second textile layer.

Preferably, the ratio of the mass of the hot melted textile portion(s) of the second textile layer to the total mass of the second layer is greater than or equal to 50%, still preferably greater than or equal to 80%, particularly greater than or equal to 90%. This disposition promotes the attachment of the first additional textile part (A) to the sole element since the hot melted textile portions form a bonding area between the first textile layer and the sole element.

Preferably, the ratio of the mass of the hot melted textile portion(s) of the first textile layer to the total mass of the first textile layer is less than or equal to 60%, even more preferably less than or equal to 40%, particularly greater than or equal to 30%.

In a fourth variant, the sole element includes a peripheral edge, and the first additional textile part (A) at least partially covers the peripheral edge.

Preferably, the peripheral edge of the sole element extends, in particular substantially vertically to the footwear, between the internal and external faces of the sole element.

Particularly, the first additional textile part (A) partially covers the peripheral edge via its textile wrapping portion.

Preferably, the first additional textile part (A), in particular its textile wrapping portion also partially covers the external face of the sole element, more particularly a region adjacent to the peripheral edge disposed on the external face of the sole element.

This disposition allows improving the resistance to delamination by reinforcing the attachment between the main textile element and the sole element.

The first additional textile part (A) may partially cover the peripheral edge of the front part of the sole element (in this case the first through-opening is in the front part of the sole portion), particularly for a footwear for the practice of soccer, or partially cover the peripheral edge of the rear part of the sole element, particularly for a footwear for the practice of basketball (in this case the first through-opening is in the rear part of the sole portion).

In a fifth variant, the first additional textile part (A) includes one or several hot melted textile portion(s) coating, at least partially, the sole element.

Particularly, the hot melted textile portion(s) are bonded to the sole element.

Preferably, the intermediate textile portion and/or the wrapping textile portion include(s) (each) one or several hot melted textile portion(s).

In a sixth variant, the first additional textile part (A) includes first and second textile layers, in particular substantially superimposed, and a receiving volume disposed between the first and second layers.

Preferably, the first and second layers are not substantially integral with each other along their surfaces.

Preferably, the first additional textile part (A) is a tube including lateral and medial through-openings disposed between the upper and lower edges of the first and second layers.

In a seventh variant, the main textile slipper includes a first textile junction portion including one or several hot melted textile portion(s), superimposed, at least partly, with the first additional textile portion (A).

Preferably, the first textile junction portion surrounds, substantially totally or partly, the first through-opening disposed in the sole portion of the main textile bootie.

The textile junction portion promotes the attachment of the main textile bootie with the additional part (A) and absorbs the variations in the placement of the first additional textile part (A) during the thermo-compression step.

In an eighth variant, the first textile junction portion includes one or several hot melted textile portion(s) which represent(s) at least 50%, in particular at least 80%, particularly at least 90%, by mass of the total mass of the first textile junction portion.

The textile junction portion is preferably not visible on the footwear because it is practically totally hot melted.

In a ninth variant, the main textile element includes a second additional textile part (B) including one or several hot melted textile portion(s), and at least partially covers the internal face of the main textile bootie, particularly forms an internal hard toe-puff.

In one embodiment, the second additional textile part (B) partially covers the internal face of the front part of the main textile bootie, particularly the internal face of the sole portion and the internal face of the toe tip of the main textile bootie.

In another embodiment, the second additional textile part (B) partially covers the internal face of the rear part of the main textile bootie, particularly the internal face of the sole portion and possibly of the rear portion, in particular so as to form a counter or a cushioning.

The second additional textile part (B) may include several textile layer(s), in particular substantially superimposed, particularly first and second superimposed textile layer(s).

Preferably, the first textile layer and/or the second textile layer include(s) (each) one or several hot melted textile portion(s).

Preferably, the second textile layer is disposed substantially between the first textile layer and the internal face of the main textile bootie.

Preferably, the ratio of the mass of the hot melted textile portion(s) of the first textile layer and/or the second textile layer to the total mass of the first textile layer and/or the second textile layer is greater than or equal to 50%, more preferably greater than or equal to 80%, particularly greater than or equal to 90%.

In a tenth variant, the second additional textile part (B) includes first and second textile layers, and a receiving volume disposed between the first and second textile layers.

A shock-absorbing and/or stiffening element may be disposed in the receiving volume. The latter may also remain empty depending on the functions sought.

In an eleventh variant, the second additional textile part (B) is in connection, at least partly, with the edge of the first through-opening.

Preferably, the second part (B) is in knitted bond with the edge of the first through-opening.

Preferably, the second part (B) is of unitary textile, in particular knitted, construction with the main textile, in particular knitted, bootie.

In a twelfth variant, the main textile element includes a third additional textile part (C) including one or several hot melted textile portion(s), the third additional textile part (C) is in connection, at least partly, with an area for introducing the foot into a foot-receiving volume of the main textile bootie.

Preferably, the third additional textile part (C) includes first and second textile layers.

Preferably, the first and second textile layers include a receiving volume disposed between the first and second, in particular substantially superimposed, textile layers. The receiving volume may be empty or include one or several shock-absorbing and/or stiffening element(s).

In one embodiment, the third additional textile part (C) partially covers the internal face of the rear portion of the main textile bootie, and partially the internal face of the lateral and medial parts of the main textile bootie, and optionally partially the internal face of the sole portion. The third additional textile part (C) is preferably in the form of a tube before the melting of the hot-meltable portions.

Preferably, the second layer is disposed between the first layer and the internal face of the main textile bootie.

Preferably, the ratio of the mass of the hot melted textile portion(s) of the second textile layer to the total mass of the second textile layer is greater than or equal to 50%, particularly greater than or equal to 80%, in particular greater than or equal to 90%.

Preferably, the ratio of the mass of the hot melted textile portion(s) of the first textile layer to the total mass of the first textile layer is less than or equal to 50%, particularly less than or equal to 40%, in particular less than or equal to 20%.

In a thirteenth variant, the main textile element includes a second textile junction portion extending, entirely or partly, between the main textile bootie and the third additional textile portion (C).

Preferably, the second textile junction portion includes one or several hot melted textile portion(s), particularly the ratio of the mass of the hot melted textile portion(s) to the total mass of the second textile junction portion is greater than or equal to 50%, particularly greater than or equal to 80%, in particular greater than or equal to 90%.

Preferably, the third part (C) is of unitary textile, in particular knitted, construction with the main textile, in particular knitted, bootie.

Preferably, the second junction portion surrounds, at least partially, the area for introducing the foot into the main textile bootie, particularly corresponding to the second introduction opening.

During the manufacture of the footwear, the third additional textile part (C) is folded against the internal face of the main textile bootie, and the second junction portion, at the level of the opening for introducing the foot, allows obtaining an aesthetic finish. The width of this second junction portion allows absorbing any problems of superimposition of the third additional textile part (C) with the main textile bootie during the step of hot-implementation of the footwear, in particular of thermo-compression described below.

In a fourteenth variant, the main textile element includes a fourth additional textile portion (D) including one or several hot melted textile portion(s), covering, at least partly, the internal face or the external face of a heel region of the main textile bootie, particularly the fourth additional textile portion (D) is in connection with the area for introducing the foot into a volume for receiving of the main textile bootie.

In one embodiment, the fourth part (D) includes carbon fibers forming an area disposed in operation under the heel of the user, and partially covering the internal face or the external face of the main textile bootie. This area forms a rebound plate.

Preferably, the fourth additional textile part partially covers the internal face of the rear portion of the main textile bootie, and possibly partly the lateral and medial parts of the main textile bootie, or partially the internal face of the sole portion of the main textile bootie.

Preferably, the fourth additional textile part (D) is in knitted connection with the opening for introducing the foot into the receiving volume of the footwear, particularly in knitted connection with the second opening of the main textile bootie.

Preferably, the fourth part (D) is of textile, in particular knitted, construction unitary with the main textile, in particular knitted, bootie.

In one embodiment, the fourth additional textile part (D) includes first and second, in particular substantially superimposed, textile layers.

Preferably, the fourth additional textile part (D) extends substantially over the entire height of the rear portion of the main textile bootie.

Preferably, the second layer of the fourth part (D) is disposed between the first layer and the internal face of the main textile bootie, and possibly also partially between the internal face of the main textile bootie and the third additional textile part (C).

Preferably, the ratio of the mass of the hot melted textile portion(s) of the first textile layer and/or of the second textile layer to the total mass of the first textile layer and/or of the second textile layer is greater than or equal to 50%, particularly greater than or equal to 80%, in particular greater than or equal to 90%.

In one sub-variant of the embodiment, the fourth additional textile portion (D) includes first and second textile layers, and a receiving volume disposed between the first and second layers.

The receiving volume may be empty or include one or several shock-absorbing and/or stiffening element(s).

In a fifteenth variant, the footwear includes a functional piece, in particular chosen among a foam, a film, a textile piece, a tag, for example an RFID tag, or a combination thereof, disposed in one or several receiving volumes(s) chosen among the volume(s) for receiving of the first, second, third and fourth additional textile portions (A, B, C, D).

In one variant, the footwear includes an assembly of fibers and/or filaments, particularly textile stuff, disposed in one or several receiving volume(s) chosen among the volume(s) for receiving the first, second, third and fourth additional textile portions (A, B, C, D).

In one embodiment, the assembly of fibers and/or filaments includes a first polymer P1 and a second polymer P2.

Preferably, the polymers P1 and P2 have melting or glass transition temperatures T1 and T2 respectively, preferably T1 is greater than T2, more preferably T1 is greater than or equal to T2+10° C. or +20° C. (T1≥T2+10° C. or +20° C.). The fibers may be chopped fibers, for example derived from cut filaments and/or yarns including the cut filaments.

The fibers and/or filaments may be bi-component ones and include the coextruded polymers P1 and P2, for example by being arranged in a core-sheat type configuration, the polymer P1 optionally being at the core.

Alternatively, the assembly of fibers may include fibers and/or filaments including the polymer P1, in particular not including the polymer P2, and fibers and/or filaments including the polymer P2, in particular not including the polymer P1.

The second polymer P2 has preferably a heat shrinkage (%) greater than the heat shrinkage (%) of the first polymer P1.

We understand by thermal shrinkage the dimensional shrinkage of the polymer material P1 or P2 under the effect of heating, particularly at the thermoforming or thermo-compression temperature.

Preferably T1 and/or T2 is/are higher than the thermoforming or thermo-compression temperature during the method for manufacturing the footwear and/or the sole structure.

The fibers and/or filaments, including the polymer materials P1 and P2, partly deform during the thermoforming or the thermo-compression, and swell, which increases the volume of the assembly of fibers and/or filaments.

The fibers and/or filaments of the assembly may be at least partly hot melted. In this case, preferably T2 is lower than or equal to the thermoforming or thermo-compression temperature.

In one variant, the first additional textile part includes first and second textile layers attached together according to one or several textile attachment, particularly knitted, area(s) delimiting channels between the first and second textile layers.

The channel(s) may extend longitudinally, that is to say along the longitudinal axis L of the footwear, and/or transversely, that is to say along the transverse axis of the shoe.

In one embodiment, the first additional textile part (A) is folded against the internal face or the external face of the main textile bootie, particularly against its sole portion at least partly, and optionally against one or several chosen portion(s) of the main textile bootie among a lateral portion, a medial portion, a front portion and a rear portion.

The first additional textile part (A) may extend in the longitudinal direction L between the rear and front edges of the sole portion and in the transverse direction T between the lateral and medial edges of the sole portion.

The first additional textile part (A) may alternately extend in the longitudinal direction L so as to cover only the rear or front portion of the main bootie, and extend in the transverse direction T between the lateral and medial edges of the sole portion.

In these last two cases, the channel(s) extend over the entire length or over the entire width of the first additional textile part A.

The channel(s) may include in their receiving volume(s) an assembly of fibers and/or filaments as defined in the present text, or a functional piece as defined in the present text.

In a sixteenth variant, the footwear includes an auxiliary textile bootie, including one or several hot melted textile portion(s), the auxiliary textile bootie is disposed on the main textile bootie and the sole element so as to cover, at least partly, the main textile bootie, the sole element and the junction between the textile bootie and the sole element.

This disposition allows obtaining an upper for the footwear including the auxiliary textile bootie and the main textile element.

The attachment with the sole element of the upper and the mechanical reinforcement of the upper are very significantly improved.

Preferably, the auxiliary textile bootie partially covers the external face of the sole element.

In one embodiment, the rear and/or sole and/or lateral and/or medial portion(s) of the auxiliary textile bootie include(s) one or several hot melted textile portion(s), particularly the hot melted portion(s) represent(s) at least 50% by mass, more particularly at least 70% by mass, in particular at least 90% by mass, of the total mass of the rear and/or sole and/or lateral and/or medial portion(s).

In one embodiment, the hot melted textile portion(s) represent(s) at least 60% by mass, at least 80% by mass of the total mass of the auxiliary textile bootie.

Preferably, the front portion of the auxiliary textile bootie includes one or several hot melted textile portion(s), and the ratio of the total mass of the hot melted textile portion(s)) on the total mass of the front part is less than or equal to 20%, in particular less than or equal to 10%.

In one embodiment, the auxiliary textile bootie is of unitary textile, particularly knitted or woven, in particular knitted, construction. Particularly, the auxiliary textile bootie and the main textile bootie are two independent textile pieces.

In one embodiment, the auxiliary textile bootie and the main textile bootie are of unitary textile, in particular knitted, construction for example in a single textile, in particular knitted, piece. The textile piece may be generally substantially L-shaped or U-shaped. Preferably, the auxiliary textile bootie and the main textile bootie are in textile, in particular knitted, connection at their openings for introducing the foot into their respective interior volumes.

In one sub-variant, the auxiliary textile bootie covers, at least partly, the first additional textile part (A), particularly the portion of the first additional textile part (A) at least partly covering the peripheral edge, and possibly the external face, of the sole element.

In a seventeenth variant, the edges of the first through-opening are not joined.

In an eighteenth variant, the auxiliary textile bootie includes a through-opening whose edges are bonded together, particularly disposed on a sole portion of the auxiliary textile bootie.

The auxiliary textile bootie preferably has a hollow elongated structure including first and second through-openings opening out into the foot-receiving volume of the auxiliary textile bootie.

Preferably, the second through-opening substantially corresponds to the second through-opening of the main textile bootie.

In a nineteenth variant, the footwear includes at least one at least partly hot melted textile viewing window, in particular including one or several at least partly hot melted transparent or opaque yarn(s).

The main textile element and/or the main textile bootie and/or the auxiliary textile bootie and/or the first and/or second and/or third and/or fourth additional textile part(s) and/or at least one textile sole element according to the disclosure may each include one or several at least partly hot melted textile viewing window(s).

For example, the auxiliary textile bootie includes an at least partly hot melted textile viewing window disposed substantially in its sole portion facing the first through-opening of the main textile bootie. The first through-opening is therefore visible from the outside of the footwear through the window.

The variants of embodiment, definitions, embodiments, with reference to the first and/or second aspect(s) of the disclosure may be combined together, independently of each other, unless otherwise specified.

In general, the first additional textile part (A) may be the second additional textile part (B) or the third additional textile part (C) or the fourth textile part (D), and thus include/have one or several characteristic(s) of the part (B) or (C) or (D) selected independently of each other.

The present disclosure relates, according to a second aspect, to a method for manufacturing a footwear, in particular according to any one of the variants of embodiments, in particular one to eighteen, with reference to the first aspect of the disclosure, including the steps:

(i) providing a main textile element including a main textile bootie, having a sole portion and including one or several hot-meltable textile portion(s);

(ii) subjecting the first textile element to a temperature making it possible to obtain the melting of the hot-meltable portion(s);

(iii) attaching, at least partially, at least one sole element, to the sole portion of the main textile bootie, step iii) taking place before, during or after step ii); and the sole portion includes a first through-opening, and the main textile element includes a first additional textile part (A), of unitary textile construction with the main textile bootie, and in connection with the first through-opening.

Preferably, the method includes a thermoforming step or a thermo-compression step, which step includes step (ii) and/or step (iii).

Preferably, steps (ii) and (iii) are carried out concomitantly.

The thermo-compression step or the thermoforming step allows the stiffening and the setting of the three-dimensional shape of the main textile bootie.

During the thermo-compression step, an inflatable flexible envelope or inflatable preform, having in particular a substantially foot shape, is placed in the foot-receiving volume of the main textile bootie, then the assembly including the main textile element, optionally an auxiliary textile bootie, the sole element, is disposed in a mold in two or several parts. Once the mold is closed, the inflatable envelope is inflated to press the main textile bootie against the internal walls of the mold, and the first and/or second and/or third and/or fourth additional textile part(s) against the internal face and/or the external face of the main textile bootie and/or the sole element and/or the internal walls of the mold it/they cover(s). Heat is concurrently applied to melt the hot-meltable portions and obtain hot melted portions. The assembly is then cooled, preferably the inflatable envelope being kept in the inflated state during the cooling.

It is possible to apply this thermo-compression step to the textile element, and possibly the auxiliary textile bootie, already attached to a sole element. In this case, if the sole portion of the main textile bootie and/or the auxiliary textile bootie include(s) hot melted textile portions, these reinforce the attachment with the sole element.

It is also possible to apply this thermo-compression step to the textile element, and possibly the auxiliary textile bootie, without a sole element. The sole element is then attached (by gluing, by heat-bonded, by sewing or any other equivalent technique known to those skilled in the art) to the thermo-compressed upper obtained.

Preferably, the footwear includes an upper including the main textile element, optionally provided with other additional textile parts (B and/or C and/or D), and optionally also with an auxiliary textile bootie.

The upper includes hot melted textile portions and flexible non-hot melted textile portions.

All of the variants of embodiments, in particular one to eighteen, as well as the embodiments, preferred arrangements and definitions, according to a first aspect of the disclosure may be combined, independently, with each other, and with the variants of embodiments with reference to the second aspect of the disclosure.

Preferably, in the present text, the expression hot-meltable is used for an element before its hot-melting with reference to the method for manufacturing a sole structure or a footwear, and the expression hot melted is used for this same element after its hot-melting with reference to the sole structure or to the footwear obtained.

DESCRIPTION OF THE DRAWINGS

The disclosure will be better understood upon reading the following description of embodiments of the disclosure given by way of non-limiting examples, with reference to the appended drawings, in which:

FIG. 1 schematically illustrates a perspective and side view of a first example of main textile element according to the disclosure;

FIG. 2 schematically illustrates a bottom view of the main textile element represented in FIG. 1;

FIG. 3 schematically represents a bottom view of the main textile element represented in FIGS. 1 and 2, as well as a first additional textile part (A), and a second additional textile part (B);

FIG. 4 schematically represents a bottom view of the main textile element represented in FIGS. 1 and 2, as well as the first additional textile part (A) and the second additional textile part (B);

FIG. 5 schematically represents a side view of the main textile element of FIG. 1, disposed on a preform, including the first additional textile part (A) which engages with a sole element;

FIG. 6 schematically illustrates a side view of the main textile element of FIG. 1, disposed on a preform, including the first additional textile part (A) engaged with a sole element;

FIG. 7 schematically illustrates a side view of a first example of auxiliary textile bootie disposed on the main textile element represented in FIGS. 1 to 6;

FIG. 8 schematically illustrates a side view of the auxiliary textile bootie of FIG. 7 slightly folded to reveal the main textile bootie;

FIG. 9 schematically illustrates a side view of the assembly including the first example of the main textile element, the sole element and the auxiliary textile bootie of FIG. 7;

FIG. 10 schematically illustrates a bottom view of the assembly of FIG. 8;

FIG. 11 schematically illustrates the footwear obtained from the thermo-compressed assembly represented in FIGS. 7 to 10, FIG. 12 schematically illustrates a side view of a second example of a main textile element further including third and fourth additional textile parts (C, D) according to the disclosure;

FIG. 13 schematically illustrates a side view of the main textile element of FIG. 12 including the third and fourth additional textile parts (C, D) deployed outside the foot-receiving volume of the main textile bootie;

FIG. 14 schematically illustrates a side view of the third and fourth additional textile portitions (C, D) of FIG. 13;

FIG. 15 schematically illustrates a bottom view of a third example of a main textile element according to the disclosure;

FIG. 16 schematically illustrates a side view of a fourth example of a main textile element according to the disclosure;

FIG. 17 schematically illustrates a side view of a fifth example of a main textile element.

DETAILED DESCRIPTION

FIG. 1 represents a first example of a main textile element 100 according to the disclosure disposed on a preform 10 and including a main textile bootie 200 and a first additional textile part (A) 300. The first additional textile part (A) includes an intermediate textile portion 320 and a wrapping textile portion 330. The main textile bootie 200 includes a sole portion 205, a medial portion 210, a lateral portion, a rear portion 215 and a front portion 220, and a through-opening 225 for the insertion of the foot into the interior volume of the main textile bootie 200 corresponding to the foot-receiving volume of the footwear 700. The main textile element 100 may include a temporary elastic textile piece 110 that allows maintaining the lateral and medial edges of the groove portion 218 of the main textile bootie 200 at a substantially constant distance, particularly during the thermo-forming step.

The main textile bootie 200 has a hollow elongated shape and includes a first through-opening 235 opening out into the interior volume of the main textile bootie 200 and disposed in the front part 206 of the sole portion 205, as well as a second through-opening corresponding to the opening 225 for introducing the foot.

The first additional textile part (A) 300 is in connection, in particular knitted connection, with the first through-opening 235, particularly with the edge of the opening 235, and projects outside the main textile bootie 200 from the edge of the first through-opening 235.

The main textile element 100 is in a knitted piece of unitary knitted construction. The annular region 240 is preferably in n×p rib stitches, for example in 1×1 rib, and optionally includes one or several elastic yarn(s).

The main textile bootie 200 also includes a partially annular textile region 240 disposed around the opening 225 for introducing the foot.

The main textile element 100 is in a knitted piece of unitary knitted construction. The annular region 240 is preferably in n*p rib stitches, for example in 1*1 rib, and optionally includes one or several elastic yarn(s).

Preferably, the first additional textile part (A) 300 is knitted, and is of unitary textile (knitted) construction with the main knitted textile element 100. The first part (A) 300 includes first and second textile layers 340, 350 substantially superimposed and including one or several at least partially hot-meltable yarn(s). The first textile layer 340 includes less than 50% by mass, in particular less than 20% by mass of at least partly hot-meltable yarn(s) relative to its total mass. The second textile layer 350 includes more than 80% by mass, in particular includes at least partially hot-meltable yarn(s) relative to its total mass.

The main textile element 100 includes a second additional textile part (B) 400 visible in FIGS. 3 and 4 in a deployed position out of the interior volume of the main textile bootie 200 through the first through-opening 235. This second additional textile part (B) 400 is preferably knitted, and is in knitted connection with the first opening 235 so that it is of unitary knitted construction with the main textile bootie 200.

In operation, this second additional textile part (B) 400 is folded into the interior volume of the main textile bootie 200, and disposed against the internal face of the main textile bootie 200, and partly covers the lateral 212 and medial 210 portions in the front part 206 of the main textile bootie 200, and partly the front portion 215 of the main textile bootie 200. The second additional textile part (B) 400 preferably includes first and second substantially superimposed textile layer(s) 410, 420, and including one or several at least partially hot-meltable yarn(s). Particularly, the first and second textile layers 410, 420 include single-component monofilament hot-meltable yarns. A receiving volume is arranged between the first and second layers 410, 420 and configured to receive a functional piece, such as a shock-absorbing or stiffening element. In this specific example, the receiving volume of the second additional part 400 (B) is empty. The two layers 410, 420 allow locally increasing the thickness of the second additional textile part (B) 400. The second additional textile part (B) 400 performs the hard toe-puff function once the at least partly melted hot-melt yarns thus form heat melted textile portions.

FIGS. 5 and 6 represent the main textile element 100 disposed on a rigid preform 10 (useful only for illustration purposes) and placed in connection with a sole element 500, in this specific example an outsole 510, in particular including multiple studs 520 projecting from the external face 515 of the outsole 510. The sole portion 205 of the main textile bootie 200 is disposed against the internal face 516 of the sole element 500, and the first additional textile part (A) 300 partially wraps the peripheral edge 517 of the sole element 500. The peripheral edge 517 extends between the internal face 516 and the external face 515 of the sole element 500, and is preferably substantially vertical. Particularly, the first additional textile part (A) 300 includes an intermediate textile portion 320 disposed between the sole portion 205 of the main textile bootie 200 and the internal face 516 of the sole element 500, and a wrapping portion 330, in the extension of the intermediate portion 320, and partially covering the peripheral edge 517 and partially the external face 515 of the sole element. The junction 20 between the main textile bootie 200 and the sole element 500 is thus locally reinforced, partially, in the front part 220 of the main textile bootie 200, and in this specific example partially in the lateral 212 and medial 210 parts. This junction 20 thus includes multiple textile thicknesses: the first and second textile layers 410, 420 of the second additional textile part (B) 400, the main textile bootie 200, and the first and second textile layers 340, 350 of the first additional textile part (A) 300. The junction 20 between the main textile bootie 200 and the sole element 500 is thus reinforced, in particular locally by the first additional textile part (A) 300. The resistance to abrasion and wear of the main textile bootie 200 and the resistance to delamination of the main textile bootie 200 of the sole element 500 will be improved when the at least partially hot-meltable yarns are melted.

It is also possible to cover the main textile element 100 and the sole element 500 with an auxiliary textile bootie 600 represented in particular in FIGS. 7 to 10. This auxiliary textile bootie 600 is preferably disposed around the main textile element 100 in connection with the sole element 500 as represented in FIG. 7. FIG. 8 represents the auxiliary textile bootie 600 slightly folded on itself to reveal the main textile element 100 disposed on the preform 10 and in connection with the sole element 500.

The auxiliary textile bootie 600 includes a rear portion 605, a medial portion 610, a lateral portion 615, a front portion 620 and a sole portion 625.

The auxiliary textile bootie 600 includes in its sole portion 625 receiving areas 626 represented in FIG. 10, particularly through-openings, receiving the studs 520 projecting from the external face of the sole element 500.

The auxiliary textile bootie 600 has a hollow elongated shape and includes first and second through-openings 630, 640. In this specific example, the second through-opening 640 is substantially superimposed with the second foot introducing through-opening 225 of the main textile bootie 200. The first through-opening 630 also opens out into the interior volume of the auxiliary textile bootie 600 but its lateral edges 632 and 634 are attached, for example by sewing. The first opening 630 of the auxiliary textile bootie 600 is therefore closed while the first opening 235 of the main textile bootie 200 remains open. The main 200 and auxiliary 600 booties are preferably knitted on a circular knitting loom of small diameter, hence their generally elongated and hollow shapes each including first and second through-openings. The second through-openings 225, 640 are substantially superimposed and correspond to the opening for introducing the foot into the footwear 700. The first through-opening 235 of the main textile bootie 200 remains open because the first additional textile part (A) projects therefrom. The rounded disposition of the second through-opening 235 kept open facilitates the partial wrapping of the substantially rounded peripheral edge 517 of the front part of the sole element 500.

The auxiliary textile bootie 600 includes an elastic annular region 650 bordering the second through-opening 640 for introducing the foot. Preferably, the elastic annular region 650 does not include hot-melt yarns.

The assembly including the main textile element 100 cooperating with the sole element 500, the auxiliary textile bootie 200, and optionally one or several reinforcing and/or stiffening and/or aesthetic element(s) is disposed in a mold in several parts, the preform 10 is replaced by an inflatable envelope housed in the foot-receiving volume of the main textile bootie 200. The parts of the mold are closed. The inflatable envelope is gradually inflated in order to press the textile parts of the assembly against the internal walls of the mold and against the inflatable envelope. The assembly is then heated to a temperature greater than or equal to the melting temperature(s) of the at least partially hot-meltable yarns in order to obtain the melting of the hot-meltable yarns and the formation of the hot melted textile portions. On leaving the thermo-compression step, the temporary elastic textile piece 110 is separated, in particular by cutting it, from the main textile bootie 200. The temperature conditions and the inflation pressure are determined by those skilled in the art depending on the nature of the implemented yarns, and possibly on the implemented functional piece(s).

The footwear 700 obtained is represented in FIG. 11 and includes an upper 710 including the textile element 100 and the thermo-compressed auxiliary textile bootie 200. The sole element 500 is disposed between the main textile bootie 200 and the auxiliary textile bootie 600. In this specific example, the sole element is a molded piece, for example in an abrasion-resistant elastomer. The first and second additional textile parts (A, B) 300, 400 respectively reinforce the junction 20 between the main textile bootie 200 and the sole element 500, as well as the front part 220 of the upper 710 by forming a hard toe-puff. The studs 520 project through the sole portion 625 of the auxiliary textile bootie 600 of the upper 710. The footwear 700 includes a longitudinal axis extending substantially between the back and the front of the article. The footwear 700 also includes a transverse axis, in particular substantially perpendicular, to the longitudinal axis.

In one embodiment, the sole portion 625 of the auxiliary textile bootie 600 includes hot melted textile, particularly transparent and/or opaque, portions making in particular the sole portion 205 of the visible main textile bootie 200. The hot melted portions are preferably arranged on the sole portion 625 facing the first through-opening 235 of the main textile bootie 200.

Advantageously, the footwear 700 has a weight on the order of 160 g.

The upper 710 of the footwear 700 could also not include an auxiliary textile bootie 600. The sole element 500 would therefore be almost completely visible. The first additional textile part (A) 300 then ensures alone resistance to the localized delamination.

FIG. 12 represents a second example of a main textile element 800 according to the disclosure disposed on a rigid preform 11 for representation purposes. This main textile element 800 is described below essentially according to its differences with the main textile element 300. The main textile element 800 includes a main textile bootie 860 including a sole portion 865, a rear portion 870, a front portion 875, a lateral portion 880 and a medial portion. This main textile element 800 also includes a temporary and therefore detachable textile piece 810, a first additional textile part (A) 850, a third additional textile part (C) 900 and a fourth additional textile part (D) 950, these third and fourth parts (C, D) 900, 950 being folded into the interior volume of the main textile bootie 860. The main textile bootie 860 includes a second through-opening 885 for introducing the foot into the interior volume of the main textile bootie 860. This second through-opening 885 is bordered partly by a region having a substantially C shape 890, particularly including n*p rib stitches, for example in 1*1 rib.

The main textile element 800 includes, in the extension of the region 890, a second textile junction portion 895, particularly including at least partially hot-meltable yarn(s). Preferably, the third additional textile part (C) 900 is in the extension of the second textile junction portion 895, and has a general C shape open towards the front part 875 of the main textile bootie 860. The third part (C) 900 includes first and second textile layers 862, 864 substantially superimposed as well as a receiving volume 863 disposed between the first and second layers 862 and 864. Preferably, the first textile layer 862 includes at least partially hot-meltable yarns representing at most 50%, in particular at most 20% by mass of the total mass of the first textile layer 862. Preferably, the second textile layer 864 includes at least partially hot-meltable yarns representing at least 80% by mass, in particular at least 95% by mass of the total mass of the second textile layer 864. Preferably, the second junction portion 895, the third part (C) 900 and the main textile bootie 860 are of unitary knitted construction. The main textile element 800 is therefore preferably a unitary knitted construction piece.

The second textile junction portion 895 extends from the edge of the second through-opening 885 of the main textile bootie 860. Particularly, the second textile junction portion 890 includes first and second substantially superimposed layers in connection with the first and second layers 862 and 864 of the third part (C) 900.

The main textile element 800 also includes a fourth additional textile part (D) 950 in connection with the second through-opening 885, in particular wholly or partly in a knitted connection with the edge of the second through-opening 885.

The fourth additional part (D) 950 includes first and second textile layers 952 and 954 delimiting therebetween a receiving volume 953. Preferably, the first and second textile layers 952, 954 each include one or several hot-meltable yarn(s) representing at least 80%, in particular at least 95%, by mass of the total mass of the fourth additional textile part (D) 950. Before the thermo-compression step, the third and fourth additional textile parts (C, D) 900, 950 as well as the second junction portion 895 are folded into the interior volume of the main textile bootie 860 as represented in FIG. 12. The fourth additional textile part (D) 950 is thus disposed, partly, between the third additional textile part (C) 900 and the internal face of the rear portion 870 of the main textile bootie 860. The second textile layer 864 of the third additional part (C) 900 thus comes against the first textile layer 952 of the fourth additional part (D) 950. The length of the fourth textile part (D) 950 is determined so as to preferably cover the entire height of the rear portion 870 and partly the lateral and medial portions.

Preferably, the receiving volume 863 of the third part (C) includes an elastic deformable piece, for example a foam, and the receiving volume of the fourth part (D) remains empty.

After the thermo-compression step, the third and fourth additional textile parts preferably form a rear stiffener. The second textile junction area 895, being essentially hot melted, absorbs any movements of the third and fourth textile parts 900 and 950 folded and superimposed during the thermo-compression.

Preferably, and generally in the present text, the first and/or second and/or third and/or fourth additional textile part(s) (A, B, C, D) is/are (each) in the form of a tube, in particular having one or two open end(s), in textile, in particular knitted, connection with all or part of the edge of a first or a second through-opening of the main textile bootie.

The auxiliary textile bootie could also include additional textile parts according to the present disclosure, in particular additional parts A, B, C or D depending on the functionalities sought.

The volume(s) for receiving the first and/or second and/or third and/or fourth additional textile part(s) may each include at least one functional piece, chosen in particular among a foam, a film, a textile piece, a tag, for example an RFID tag, or a combination thereof.

The footwear 700 described above may implement the arrangements described above at the level of the opening for introducing the foot 885 into the receiving volume of the main textile bootie, particularly a third additional textile part (C) and/or a fourth additional textile part (D).

FIG. 15 represents a third example of a main textile element 1000 including a main textile bootie 1100 including a sole portion 1110. The sole portion 1110 includes a front part 1120 and a rear part 1130. The sole portion 1110 includes a first through-opening 1140 opening out into the interior volume of the main textile bootie 1100 and which may be disposed in the front part 1120 or in the rear part 1130. The main textile bootie 1100 includes a first textile junction portion 1150 including one or several hot-melt yarn(s) bordering wholly or partly the edge of the first through-opening 1140. In FIG. 15, the first junction portion 1150 surrounds substantially all the first through-opening 1140. The main textile element 1000 includes a first additional textile part (A) not represented, and may include a second and/or third and/or fourth additional textile part(s) (B, C, D) according to the disclosure.

FIG. 16 represents a fourth example of a main textile element 1200 according to the disclosure including a main textile bootie 1210, a first additional textile part (A) 1220 and a second additional textile part (B) 1230 disposed in the interior volume of the main textile bootie 1210 and substantially superimposed.

FIG. 17 represents a fifth example of a main textile element 1300 including a main textile bootie 1310 according to the disclosure, a first additional textile part (A) 1320 and a second additional textile part (B) 1330. The first part (A) 1320 projects outside the main textile bootie 1310 and at least partially wraps the external face of the front part 1340 of the main textile bootie 1310. The second part (B) 1330 projects into the interior volume of the main textile bootie 1310 and at least partially covers the internal face of the front part 1340 of the main textile bootie. The first and second parts 1320, 1330 may be dimensioned so as to partially cover the medial and lateral parts of the main textile bootie 1310. The front part 1340 of the main textile bootie 1310 is thus sandwiched, at least partially, between the first part (A) 1320 and the second part (B) 1330.

It is thus possible to locally functionalize the external face and/or the internal face of the main textile bootie via one or several additional textile part(s) (A, B, C or D), which are advantageously of textile, in particular knitted, construction unitary with the main textile bootie so as to form a main textile element functionalized according to the use of the footwear, in particular according to a determined sport.

It is understood in the context of the present disclosure that the first additional textile part (A) may be the part B or C or D, and therefore include any one of the characteristics of the part B or C or D.

The main textile bootie 200 or 860 or 1100 or 1210 or 1310, and/or the auxiliary textile bootie 600 include(s) one or several wholly or partly hot-melt yarn(s) whose nature, mode of connection, stitch pattern for example, and quantity, vary according to the functions to be attributed to the upper of the footwear.

The invention claimed is:

1. A footwear comprising a main textile element comprising a main textile bootie having a sole portion attached, at least partially, to at least one sole element, the main textile element also comprises one or several hot melted textile portion(s), wherein the sole portion comprises a first through-opening, and wherein the main textile element comprises at least a first additional textile part, of unitary textile construction with the main textile bootie, and in connection with said first through-opening, and wherein the first additional textile part comprises an upper edge, and wherein the first additional textile part is bonded by knitting along its upper edge to an edge of the first through-opening.

2. The footwear according to claim 1, wherein the first additional textile part at least partially wraps said sole element.

3. The footwear according to claim 2, wherein the first additional textile part comprises an intermediate textile portion disposed between the sole portion of the main textile bootie and said sole element.

4. The footwear according to claim 1, wherein said sole element comprises a peripheral edge, and wherein the first additional textile part at least partially covers said peripheral edge.

5. The footwear according to claim 1, wherein the first additional textile part comprises one or several hot melted textile portion(s) covering, at least partially, the sole element.

6. The footwear according to claim 1, wherein the first additional textile part comprises first and second textile layers and a receiving volume disposed between said first and second layers.

7. The footwear according to claim 6, comprising a functional piece disposed in the receiving volume of the first additional textile part.

8. The footwear according to claim 7, comprising a functional piece chosen among a foam, a film, a textile piece, a tag, or a combination thereof, disposed in one or several receiving volume(s) of the first additional textile parts.

9. The footwear according to claim 1, wherein the main textile bootie comprises a first textile junction portion comprising one or several hot melted textile portion(s), superimposed, at least partly, with the first additional textile portion.

10. The footwear according to claim 9, wherein the first textile junction portion comprises one or several hot melted textile portion(s) which represents(s) at least 50% by mass of the total mass of the first textile junction portion.

11. The footwear according to claim 1, wherein the main textile element comprises a second additional textile part comprising one or several hot melted textile portion(s), and at least partially covers the internal face of the main textile bootie.

12. The footwear according to claim 11, wherein the second additional textile part forms an internal hard toe-puff.

13. The footwear according to claim 11, wherein the second additional textile part comprises first and second textile layers, and a receiving volume disposed between the first and second textile layers.

14. The footwear according to claim 11, wherein the second additional textile part is in connection, at least partly, with the edge of the first through-opening.

15. The footwear according to claim 1, wherein the main textile element comprises a third additional textile part comprising one or several hot melted textile portion(s), said third additional textile part is in connection, at least partly, with an area for introducing the foot into a foot-receiving volume of the main bootie.

16. The footwear according to claim 15, wherein the third additional textile part comprises first and second textile layers, and a receiving volume disposed between said first and second layers.

17. The footwear according to claim 15, wherein the main textile element comprises a second textile junction portion extending between the main bootie and the third additional textile part.

18. The footwear according to claim 1, wherein the main textile element comprises a fourth additional textile part comprising one or several hot melted portion(s), covering, at least partly, the internal face or the external face of a heel region of the main bootie.

19. The footwear according to claim 18, wherein the fourth additional textile part is in connection with the area for introducing the foot into a volume for receiving of the main bootie.

20. The footwear according to claim 18, wherein the fourth additional textile part comprises first and second textile layers, and a receiving volume disposed between said first and second layers.

21. The footwear according to claim 1, comprising an auxiliary textile bootie, comprising one or several hot melted textile portion(s), the auxiliary textile bootie being disposed on the main bootie and the sole element so as to cover, at least partly, the main textile bootie, the sole element and the junction between the main textile bootie and the sole element.

22. The footwear according to claim 21, wherein the auxiliary textile bootie covers, at least partly the portion of the first additional textile part at least partly covering the peripheral edge, and at least partly the external face of the sole element.

23. The footwear according to claim 21, wherein the auxiliary textile bootie comprises a through-opening whose edges are attached together.

24. The footwear according to claim 1, wherein the edges of the first through-opening are not joined.

25. The footwear according to claim 1, wherein the first additional textile part comprises first and second textile layers each having upper edge, and wherein the upper edges of the first and second textile layers are bonded by knitting to an edge of the first through-opening.

26. The footwear according to claim 1, wherein the main textile bootie comprises an external face, and wherein the first additional textile part partially wraps the external face of the main textile bootie.

27. The footwear according to claim 1, wherein the main textile bootie comprises an internal face, and wherein the first additional textile part partially wraps the internal face of the main textile bootie.

28. A method for manufacturing a footwear, the method comprising the steps of:

(i) providing a main textile element comprising a main textile bootie, having a sole portion and comprising one or several hot-meltable textile portion(s);

(ii) subjecting said first main textile element to a temperature to obtain the melting of said hot-meltable portion(s); and (iii) attaching, at least partially, at least one sole element, to the sole portion of the main textile bootie, step iii) taking place before, during or after step ii); wherein the sole portion comprises a first through-opening, and wherein the main textile element comprises a first additional textile part, of unitary textile construction with the main textile bootie, and in connection with said first through-opening, wherein the first additional textile part comprises an upper edge, and wherein the first additional textile part is bonded by knitting along its upper edge to an edge of the first through-opening.

29. A footwear comprising a main textile element comprising a main textile bootie having a sole portion attached, at least partially, to at least one sole element, the main textile element also comprises one or several hot melted textile portion(s), wherein the sole portion comprises a first through-opening, and wherein the main textile element comprises at least a first additional textile part, of unitary textile construction with the main textile bootie, and in connection with said first through-opening, and wherein the first additional textile part comprises first and second textile layers and a receiving volume disposed between said first and second layers.

30. A footwear comprising a main textile element comprising a main textile bootie having a sole portion attached, at least partially, to at least one sole element, the main textile element also comprises one or several hot melted textile portion(s), wherein the sole portion comprises a first through-opening, wherein the main textile element comprises at least a first additional textile part, of unitary textile construction with the main textile bootie, and in connection with said first through-opening, and wherein said footwear comprises an auxiliary textile bootie, comprising one or several hot melted textile portion(s), the auxiliary textile bootie being disposed on the main textile bootie and the at least one sole element so as to cover, at least partly, the main textile bootie, the sole element and the junction between the main textile bootie and the sole element.

31. A footwear comprising a main textile element comprising a main textile bootie having a sole portion attached, at least partially, to at least one sole element, the main textile element also comprises one or several hot melted textile portion(s), wherein the sole portion comprises a first through-opening, and wherein the main textile element comprises at least a first additional textile part, of unitary textile construction with the main textile bootie, and in connection with said first through-opening, wherein the first additional textile part comprises first and second textile layers each having upper edge, and wherein the upper edges of the first and second textile layers are bonded by knitting to an edge of the first through-opening.

* * * * *